US006452490B1

(12) United States Patent
Garland et al.

(10) Patent No.: US 6,452,490 B1
(45) Date of Patent: Sep. 17, 2002

(54) HOME/COMMERCIAL SECURITY MONITORING SYSTEM

(75) Inventors: Stuart Mandel Garland, Morton Grove, IL (US); John Andrew Johnson, Wheaton, IL (US); Eric Edward Kampmeier, Sycamore, IL (US); James Allen Kowal, Naperville, IL (US); David B. Smith, Hinsdale, IL (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/382,282

(22) Filed: Aug. 24, 1999

(51) Int. Cl.[7] ..... G08B 29/00

(52) U.S. Cl. ..... 340/506; 340/3.1; 340/521; 340/535; 340/531; 340/825.69; 379/37; 379/38; 370/913

(58) Field of Search ..... 340/506, 3.1, 521, 340/539, 531, 825.69; 379/37, 38, 39; 370/912, 913

(56) References Cited

U.S. PATENT DOCUMENTS 5,086,385 A * 2/1992 Launey et al. ..... 704/274
5,793,839 A * 8/1998 Farris et al. ..... 379/34
6,060,994 A * 5/2000 Chen ..... 340/825.06

* cited by examiner

*Primary Examiner*—Daryl Pope
(74) *Attorney, Agent, or Firm*—Werner Ulrich

(57) ABSTRACT

A method and apparatus for communicating between Customer Premises Equipment, (CPE) alarm sensing devices, and alarm monitoring stations. The sensing devices communicate with an end office switch by transmitting a message, such as a string of Dual-Tone Multi-Frequency, (DTMF) digits to that switch. At the switch, the message is processed and a determination is made which of a plurality of alarm monitoring stations should receive the alarm indication. One or more data packets are sent to the selected alarm monitoring stations with the packets identifying the source of the alarm indication, and the type of alarm indication. Advantageously, the packetized communication between the end office switch and the alarm monitoring system allows a high volume of alarm indications to be sent to an alarm monitoring station, because individual telephone connections are not required for each such alarm message.

38 Claims, 2 Drawing Sheets

HOME/COMMERCIAL SECURITY MONITORING SYSTEM

TECHNICAL FIELD

Figure 1:
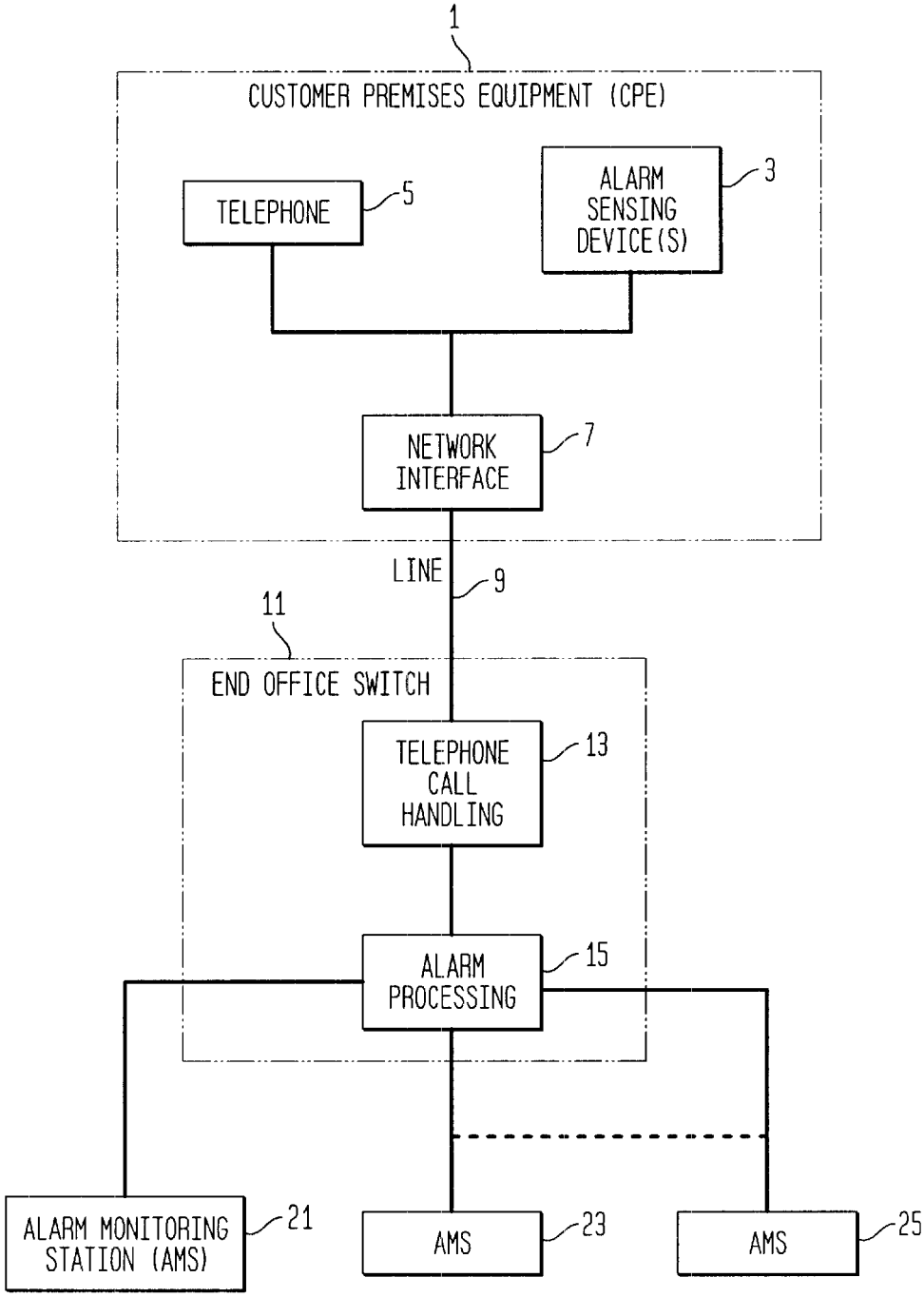

This invention relates to security arrangements, and more specifically, to methods and apparatus for communicating between customer premises equipment, (CPE) security/person monitoring alarm sensor devices, and monitoring stations.

Problem

A common type of security system has customer premises equipment, (CPE) for detecting security/personal monitoring problems, (unauthorized entry, fire and/or smoke detection, flooding, heart attack, etc.). In response to the detection of one of these events, the detection system automatically dials a telephone number to an appropriate security monitoring station, and transmits to that station a signal, or series of signals to identify the alarmed event, (date, time, device, etc.).

A problem with this type of arrangement is that in order to serve a large number of customers, a large number of lines or trunks to the security monitoring station are required in order to handle the maximum number of simultaneously occurring alarm conditions.

Solution

The above problem is solved, and an advance is made over the teachings of the prior art in accordance with this invention wherein the alarm message is captured in the end office serving the customer who has the sensing device, and wherein equipment in that switch converts the message received from the sensing device into one or more packets of data for transmission to the appropriate monitoring station. Advantageously, the holding time of these packets is much less than the holding time of the prior art connection from the customer premises equipment to the monitoring station. Advantageously, individual call set-up between the switch and the monitoring station for each alarm condition is avoided. Advantageously, a plurality of the alarm packets can be stored for transmission with minimum delay. Advantageously, this arrangement makes it economically feasible to send frequent, (e.g., hourly), "all seems well", (ASW) indications from the CPE. The result of all of these advantages is that only one or two data links from the end office switch to the monitoring station are required to serve a very large number of customer premises having security devices.

In accordance with one preferred embodiment, the line monitoring feature detects call events such as originations, partial dials, and disconnects for all monitored lines. The line monitoring feature can then be used to detect specifically the occurrence of an origination and partial dial, without a call set-up request, to pass this information to a software implemented security monitor. The switch based security monitor checks to ensure that a special prefix, such as "*222", is at the beginning, and a special suffix, (e.g., #) at the end of the digit string in order to filter out the alarm events. If such a digit string is detected, normal error routines are suspended, (except for an overall time-out), and the balance of the digit string is examined in order to determine the appropriate monitoring station, (Fire House, Police Headquarters, Hospital, personal contacts, etc.), and converts the contents of the digit string, describing the alarm indication into one or more packets for transmission to the remote security monitoring station. Advantageously, this system can then take advantage of existing carefully designed, and continually updated software, to perform the job of isolating alarm indication messages.

The CPE can be arranged to send a "last gasp" alarm message prior to shutting down because of a failure in the equipment, for example, a low battery condition in the alarm sensor, (perhaps of a heart monitor). The equipment is continuously monitored internally, and when a failure is detected, the equipment for sending out a "last gasp" alarm message is automatically triggered prior to the CPE alarm detecting equipment being shut down. Advantageously, this arrangement can result in the alarm bureau being notified and being requested to send a repair craftsperson to fix the CPE.

BRIEF DESCRIPTION OF THE DRAWING(S)

Figure 2:
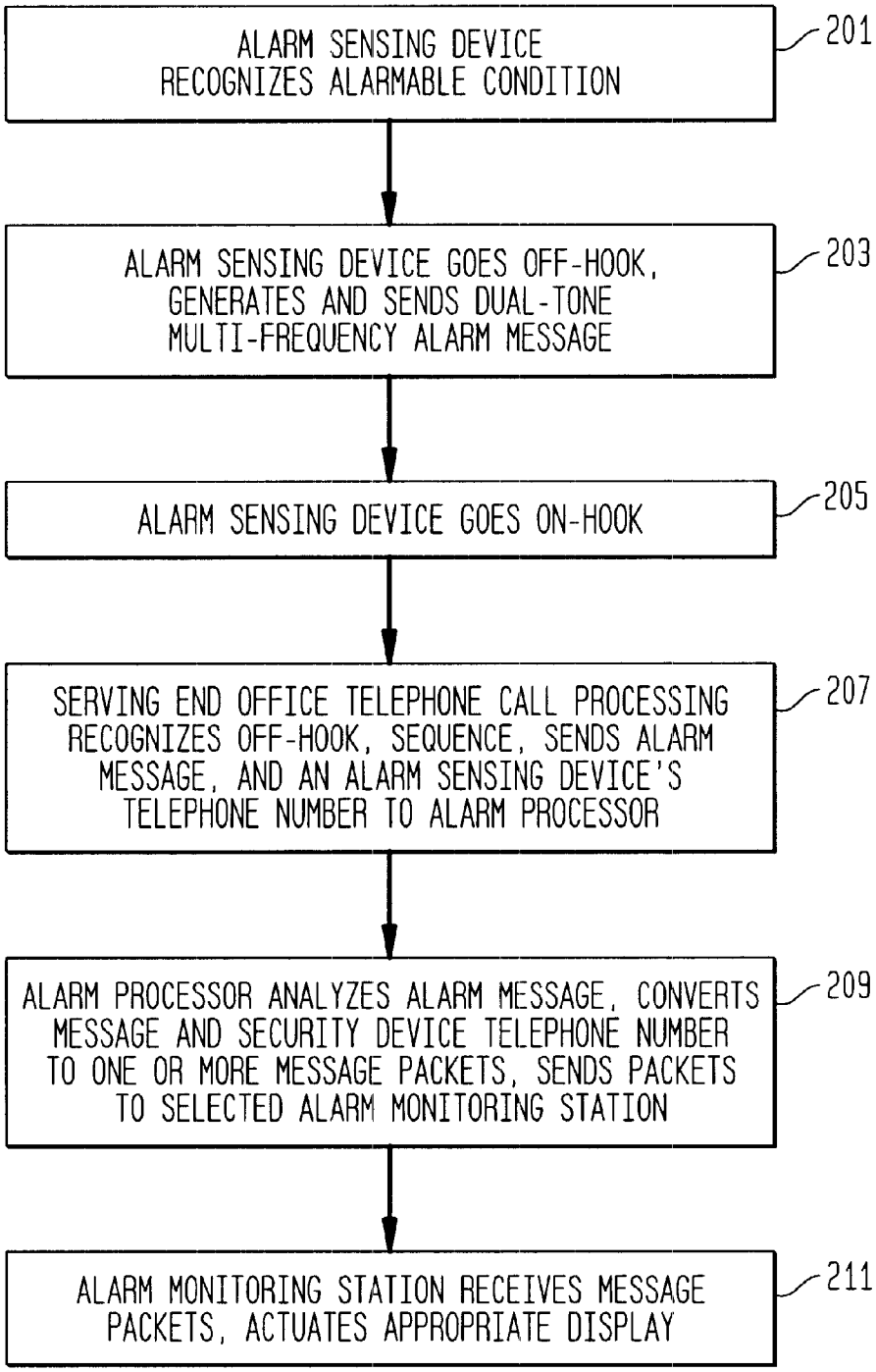

FIG. 1 is a block diagram, illustrating the basic architecture of Applicants' invention; and FIG. 2 is a flow diagram, illustrating the operation of Applicants' invention.

DETAILED DESCRIPTION

FIG. 1 is a block diagram showing the architecture of Applicants' invention. The prior art CPE is enhanced to establish a call connection to the switch, to dial the required digits, including prefix, suffix, and alarm identifying digits, and to disconnect after the call connection has been acknowledged. In the prior art, the connection is to the home security system, (via the switch).

In addition, the CPE must administer the sending of messages so that a string of messages is not sent for a single event, but that a repeated message may be sent after a period of time for a persistent alarm. The customer premises equipment 1, includes an alarm sensor device 3, a telephone 5, and a network interface 7, connecting the telephone and the home security device to the line 9, connecting the customer premises equipment to the serving end office switch 11. The alarm sensor device is programmed to generate an off-hook signal, followed by a series of Dual-Tone Multi-Frequency, (DTMF) signals when an alarm condition is detected. The CPE waits for dial tone, or simply waits a predetermined interval of time. Waiting for dial tone improves the reliability. In contrast to the call scenario of the home security device in the prior art, wherein that device first dials the number of a security monitoring station, and after waiting for a suitable interval, or in response to receipt of tone signal(s), emits the Frequency Shift Keying, (FSK) signals corresponding to the alarm condition, the home security device of this disclosure emits the DTMF alarm indication digits as soon as it receives dial tone, since the DTMF signals go only to the end office switch, and do not go directly to a remote security monitoring station. In the end office switch, the line is connected to a digit receiver of the telephone call handling system 13. The digit receiver system accepts and stores all of the digits received from the home security device, and, in response to having recognized the preliminary digits and suffix, or in response to an on-hook signal sent after the alarm digits, sends the information represented by these digits to a security processing system 15. The security processing system analyzes the received DTMF digits in order to determine which security monitoring station should receive one or more packets of information describing the alarm, and converts the alarm message into one or more packets of data. In case the security monitoring station serves several functions, the security processing system 15 can provide a specific directory number associated with one function, to the destination security monitoring stations 21, 23, . . . , 25. The telephone call handling system has identified the caller's telephone number, and this is passed on as part of the packets of data to the security monitoring system. The security processing system selects among a plurality of different types of security monitoring stations 21, 23, 25, and sends the alarm packets to the appropriate security monitoring station, or to a personal contact, (e.g., a plumber, electrician, neighbor).

The security monitoring station selection can be based on the customer profile as stored in translation data of database 17 for the line of the CPE, and modifiable using the "Recent Change" facility for updating such translation information; within the translation data, it can be based on a number received from the CPE, identifying the type and seriousness of the alarm. It can depend on the season, day of the week and time of day, so that a centralized security monitoring station can be used on weekends, nights, or holidays.

The CPE can emit message other than DTMF digit strings. It can emit dial pulse digits (using combinations such as "11" to replace "*", or "#"), or it can use the control channel of an Integrated Services Digital Network, (ISDN) telephone to send a data message.

FIG. 2 is a flow diagram, illustrating the operation of Applicants' invention. A sensing device recognizes an alarmable condition, (Action Block 201). The alarm sensing device goes off-hook, generates and sends a Dual-Tone Multi-Frequency, (DTMF) alarm message as a partial dial digit string, (Action Block 203). The alarm sensing device then goes on-hook, (Action Block 205). The telephone call handling system of the connected end office recognizes the "off-hook", "on-hook" sequence, and any special prefix digits such as the alarm access code, recognizes that the caller has subscribed to alarm service, looks at the customer data profile as stored in the customer's translation information, and formats and sends an alarm message to the alarm processor, (Action Block 207). The call processing system also sends the telephone number of the customer premises that contain the alarm sensing device to the switch alarm processor. The message type can be used for selecting one or more alarm monitoring stations. The switch alarm processor analyzes the alarm message to determine the appropriate remote alarm monitoring station or other destination for receiving that message, converts the message into one or more packets, and sends that message to the selected remote alarm monitoring station, (Action Block 209). The remote alarm monitoring station receives the message packet, and actuates an appropriate display to alert personnel, or performs other actions, (e.g., sounding an alarm), at that monitoring station, (Action Block 211).

The principles of this invention can be used to simplify the processing of detecting a cut line connection between the switch and the CPE. Because no direct connection is required between the security monitoring station and the CPE, the switch can be used to check for a cut line. This can be done in one of several ways. The CPE can be polled periodically via the line unit of the switch to ensure that the CPE responds to the polling request. A suppressed ringing call can be established to the CPE to check for the proper operation of the CPE, or simply to check for a confirmation that the CPE is attached. The CPE can continuously emit a tone, or a cadenced tone when on-hook, (and not in an on-hook suppressed ringing connection), and the switch can periodically check for the presence of this cadenced tone when the CPE is on-hook; if the absence of the tone, or cadenced tone, is not followed shortly by an off-hook signal, this is in an indication that the signal between the CPE and the switch is defective, either because of a trouble condition, or because the connection has been cut. In all of these cases, a line cut indication is forwarded to an alarm monitoring station for proper disposition as in the prior art. This may be particularly useful to verify signal continuity to Private Branch Exchanges (PBXs), or other smaller in-house wiring configurations that are the responsibility of the subscriber. The carrier can place a device in a wiring closet for communications to ensure the availability of the line from the subscriber equipment to the central office. (All other breaks in the line are the responsibility of the subscriber under most "in-house" wiring agreements).

The above description is of one preferred embodiment of Applicants' invention. Many other embodiments will be apparent to those of ordinary skill in the art. The invention is only limited by the attached Claims.

What is claimed is:

1. A method of alerting an alarm monitoring station of an alarmable condition, said alarm for response to said alerting, comprising the steps of:

detecting said alarmable condition at a customer's premises;

sending a message representing said alarmable condition over a telephone line to an end office switch serving said customer premises equipment alarmable conditions;

in said end office switch, analyzing said message to generate at least one packet of data describing the alarm event for transmission to an alarm monitoring system; and transmitting said at least one packet over a reserved transmission facility used for transmitting packets describing a plurality of concurrent alarm events from said end office switch to said alarm monitoring station;

wherein the step of analyzing further comprises the step of analyzing a plurality of concurrent messages from a plurality of customer premises equipments for transmission to said alarm monitoring station over said transmission facility;

wherein no individual trunk connection to said alarm monitoring station is required for each new detected alarmable condition.

2. The method of claim 1, wherein the step of sending a message to an end office switch comprises the step of sending a string of Dual-Tone Multi-Frequency, (DTMF) digits.

3. The method of claim 1, wherein the step of sending a message to an end office switch comprises the step of sending a string of dial pulse digits.

4. The method of claim 1, wherein the step of sending a message to an end office switch comprises the step of sending data in Frequency Shift Keyed, (FSK) form.

5. The method of claim 1, wherein the step of sending a message to an end office switch comprises the step of sending an Integrated Service Digital Network, (ISDN) control channel message from CPE having ISDN facilities.

6. The method of claim 2, wherein the step of sending a message to an end office switch comprises the step of sending a partial dial string of digits.

7. The method of claim 3, wherein the step of sending a message to an end office switch comprises the step of sending a partial dial string of digits.

8. The method of claim 1, wherein said alarm monitoring station is one of a plurality of security monitoring stations, and further comprising the step of:

selecting one of said plurality of alarm monitoring stations for transmission of said at least one packet.

9. The method of claim 8, wherein the step of selecting one of said plurality of alarm monitoring stations comprises the step of processing translation data for a customer at said customer premises equipment (CPE).

10. The method of claim 9, further comprising the step of modifying said translation data for said customer using Recent Change facilities of said end office switch.

11. The method of claim 10, wherein the step of processing said customer's translation data comprises the step of processing said customer's translation data with respect to date and time of said detecting said alarmable condition.

12. The method of claim 8, wherein the step of selecting comprises the step of selecting based on translation data for said end office switch.

13. The method of claim 12, further comprising the step of:

modifying said translation data for said central office for said end office switch using Recent Change capabilities.

14. The method of claim 12, wherein the step of processing said office translation data comprises the step of processing said office translation data with respect to a day and time of said detecting said alarmable condition.

15. The method of claim 1, further comprising the step of detecting a cut line between said end office switch and said customer premises equipment, (CPE) using facilities of said end office switch.

16. The method of claim 15, further comprising the step of periodically polling said CPE from said end office switch to verify a connection between said end office switch and said CPE.

17. The method of claim 15, further comprising the step of placing a suppressed ringing call to said CPE to verify transmission capability between said CPE and said end office switch.

18. The method of claim 15, further comprising the step of monitoring for a tone or cadenced tone signal from said CPE to verify transmission capability between said CPE and said end office switch.

19. The method of claim 1, wherein the step of sending a message comprises the step of sending a message over a telephone line shared with at least one telephone station at said customer premises.

20. Apparatus for alerting an alarm monitoring station of an alarmable condition, comprising:

means for detecting said alarmable condition at a customer's premises;

means for sending a message representing said alarmable condition to a telephone end office switch serving said customer premises equipment;

in said telephone end office switch, means for analyzing said message to generate at least one packet of data describing the alarm event for transmission to an alarm monitoring system; and transmission means used for transmitting packets describing a plurality of concurrent alarm events, said transmission means for said at least one packet from said telephone end office switch to said alarm monitoring station being reserved for transmitting a plurality of concurrent alarm conditions;

wherein said telephone end office switch analyzes a plurality of concurrent messages from a plurality of customer premises equipments for transmission means;

wherein no individual call trunk connection to said alarm monitoring station is required for each new detected alarmable condition.

21. The apparatus method of claim 20, wherein the means for sending a message to an end office switch comprises the means for sending a string of Dual-Tone Multi-Frequency, (DTMF) digits.

22. The apparatus of claim 20, wherein the means for sending a message to an end office switch comprises means for sending a string of dial pulse digits.

23. The apparatus of claim 20, wherein the means for sending a message to an end office switch comprises means for sending data in Frequency Shift Keyed, (FSK) form.

24. The apparatus of claim 20, wherein the means for sending a message to an end office switch comprises means for sending an Integrated Service Digital Network, (ISDN) control channel message from CPE having ISDN facilities.

25. The apparatus of claim 21, wherein the means for sending a message to an end office switch comprises means for sending a partial dial string of digits.

26. The apparatus of claim 22, wherein the means for sending a message to an end office switch comprises means for sending a partial dial string of digits.

27. The apparatus of claim 20, wherein said alarm monitoring station is one of a plurality of security monitoring stations, and further comprising:

means for selecting one of said plurality of alarm monitoring stations for transmission of said at least one packet.

28. The apparatus of claim 27, wherein the means for selecting one of said plurality of alarm monitoring stations comprises means for processing translation data for a customer at said customer premises equipment (CPE).

29. The apparatus of claim 28, further comprising means for modifying said translation data for said customer using Recent Change facilities of said end office switch.

30. The apparatus of claim 29, wherein the means for processing said customer's translation data comprises means for processing said customer's translation data with respect to date and time of said detecting said alarmable condition.

31. The apparatus of claim 27, wherein the means for selecting comprises means for selecting based on translation data for said end office switch.

32. The apparatus of claim 31, further comprising:

means for modifying said translation data for said central office for said end office switch using Recent Change capabilities.

33. The apparatus of claim 31, wherein the means for processing said office translation data comprises means for processing said office translation data with respect to a day and time of said detecting said alarmable condition.

34. The apparatus of claim 20, further comprising means for detecting a cut line between said end office switch and said customer premises equipment, (CPE) using facilities of said end office switch.

35. The apparatus of claim 34, further comprising means for periodically polling said CPE from said end office switch to verify a connection between said end office switch and said CPE.

36. The apparatus of claim 34, further comprising means for placing a suppressed ringing call to said CPE to verify transmission capability between said CPE and said end office switch.

37. The apparatus of claim 34, further comprising means for monitoring for a tone or cadenced tone signal from said CPE to verify transmission capability between said CPE and said end office switch.

38. The apparatus of claim 20, wherein said means for sending a message comprises means for sending a message over a telephone line shared with at least one telephone station at said customer premises.

* * * * *